United States Patent [19]

Kurosawa

[11] Patent Number: 4,620,529

[45] Date of Patent: Nov. 4, 1986

[54] FOOT BATH

[75] Inventor: Tadashi Kurosawa, Urawa, Japan

[73] Assignee: Tensho Electric Industrial Co., Ltd., Tokyo, Japan

[21] Appl. No.: 580,634

[22] Filed: Feb. 16, 1984

[51] Int. Cl.[4] ..... A61H 29/00

[52] U.S. Cl. ..... 128/66; 128/25 B; 128/32

[58] Field of Search ..... 128/66, 65, 62, 260, 128/51, 52.1 R, 1 R, 32, 25 B; 4/158; 604/293

[56] References Cited

U.S. PATENT DOCUMENTS

| | | | |
|---|---|---|---|
| D. 250,206 | 11/1978 | Levin | 128/66 |
| 2,025,936 | 12/1935 | Clearman | 128/66 |
| 3,001,208 | 9/1961 | Rosoff | 128/66 |
| 3,055,357 | 9/1962 | Redka | 128/66 |
| 3,283,756 | 11/1966 | Turley | 128/66 |
| 3,380,080 | 4/1968 | Farrell | 128/66 |
| 3,612,052 | 10/1971 | Krummenacher | 128/66 |
| 3,741,201 | 6/1973 | Oudkerk | 128/66 |
| 3,837,334 | 9/1974 | Johnson | 128/66 |
| 3,939,825 | 2/1976 | Krummenacher | 128/66 |
| 4,047,522 | 9/1977 | Plugge | 128/66 |
| 4,099,522 | 7/1978 | Alenares | 128/66 |
| 4,184,488 | 1/1980 | Bielich | 128/66 |
| 4,281,423 | 8/1981 | Fukunaga et al. | 128/66 |

*Primary Examiner*—Gene Mancene
*Assistant Examiner*—J. Hakomaki
*Attorney, Agent, or Firm*—Wenderoth, Lind & Ponack

[57] ABSTRACT

This invention relates to a foot bath for recovering from fatigue, easing of neuralgia and muscle-ache, removing stiffness in the neck and shoulders by increasing the circulation of blood, maintaining health, recovering from nervousness and remedying various diseases. The foot bath of the invention comprises a foot bath body which a person's feet enter and in which hot water is contained. It also comprises hot water jets to inject hot water into the foot bath body from a front face thereof, foot vibrators to provide vibration to the whole feet including the soles thereof, calf vibrators to provide vibration to the person's calves, toe stimulators to provide a stimulus to the person's toes, and extreme infrared radiators to provide far infrared rays to the feet.

14 Claims, 3 Drawing Figures

FOOT BATH

BACKGROUND OF THE INVENTION

1. Field of the Invention

The present invention relates to a foot bath for stimulating a person's feet.

2. Description of the Prior Art

A sole of a person's foot has many vital points in oriental medicine which points have a close relation to various organs. It is well known that stimulus of the vital points causes fatigue to be overcome and also the organs to be revitalized. Since about 60% of blood which is called movable organ blood is located in a person's hands and legs, the organs which tend to have congestion of blood are the feet and legs for the person who works standing for a lot of time. Thus, it is commonly said that the phenomena of aging starts from the feet. Furthermore, the feet which are closed or unnecessarily fixed in their shape by socks or shoes without breathing at their skin for a long time tend to be most dirty and also act most unhealthily among the organs, which causes various kinds of fatigue to be provided and also the organs to be badly affected. Although the feet are most important, people take little or no interest in them. Heretofore, various complicated and expensive devices which have an object of stimulating the back and shoulders other than the feet have been developed, but foot stimulating devices have not been developed except for a mat for stimulating a foot sole and a foot treading bamboo mat.

SUMMARY OF THE INVENTION

Accordingly, it is a principal object of the invention to provide a foot bath adapted to stimulate a person's feet by a hot water jet stream as well as by a vibration massage.

It is another object of the invention to provide a foot bath adapted to stimulate a person's vital points such as the calves and toes as well as the feet by a hot water jet stream as well as by a vibration massage.

It is another object of the invention to provide a foot bath adapted to provide far infrared rays to a person's feet so as to regenerate the blood.

It is another object of the invention to provide a foot bath adapted to provide a finger-pressure cure to a person's feet.

It is further object of the invention to provide a foot bath in which hot water can be circulated without introducing it out of the foot bath.

It is further object of the invention to provide a foot bath in which hot water is adapted to be maintained at its temperature suitable for stimulus and massage of a person's feet.

It is further object of the invention to provide a foot bath in which hot water can be always cleaned without any pollution due to a person's dirt and dust.

It is further object of the invention to provide a foot bath in which water can be easily removed out of the foot bath.

In accordance with the invention, there is provided a foot bath comprising;

a foot bath body which a person's feet are to enter and having a cover openably mounted thereon;

hot water jets to inject foamed hot water into the foot bath body from a front face thereof;

foot vibrators to provide a vibration massage to soles of the person's feet together with the whole feet by wave vibration of the hot water which is provided by the vibration;

calf vibrator provided at the rear portion of the foot bath body to engage the person's calves to provide a vibration massage to the calves;

toe stimulator means provided at the front portion of the foot bath body to engage the person's toes in a bent manner so as to effectively provide vibration to the toes;

finger-pressers to provide a finger-pressure massage to the soles of the feet;

and extreme infrared radiators provided on a back of the cover to provide far infrared rays to the feet.

BRIEF DESCRIPTION OF THE DRAWINGS

The above and other objects and features of the invention will be apparent from the description of the embodiment taken along with reference to the accompanying drawings in which.

DETAILED DESCRIPTION OF THE EMBODIMENT

Figure 1:
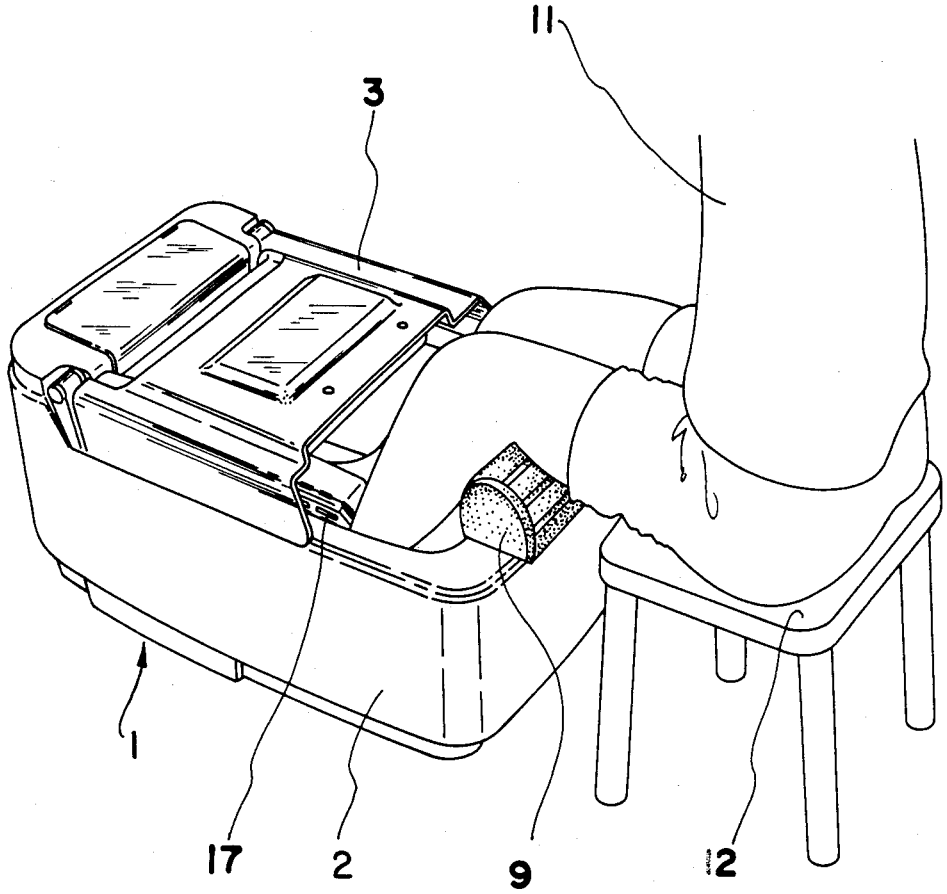
FIG. 1 is a perspective view of a foot bath constructed in accordance with one embodiment of the invention with a person's feet entering the foot bath.

Referring now to FIG. 1, a foot bath 1 of the invention comprising a foot bath body 2 into which feet of a user 11 are to enter and having a cover 3 pivotally supported on the foot bath body 2 at its front portion thereof so as to be openably moved.

Figure 3:
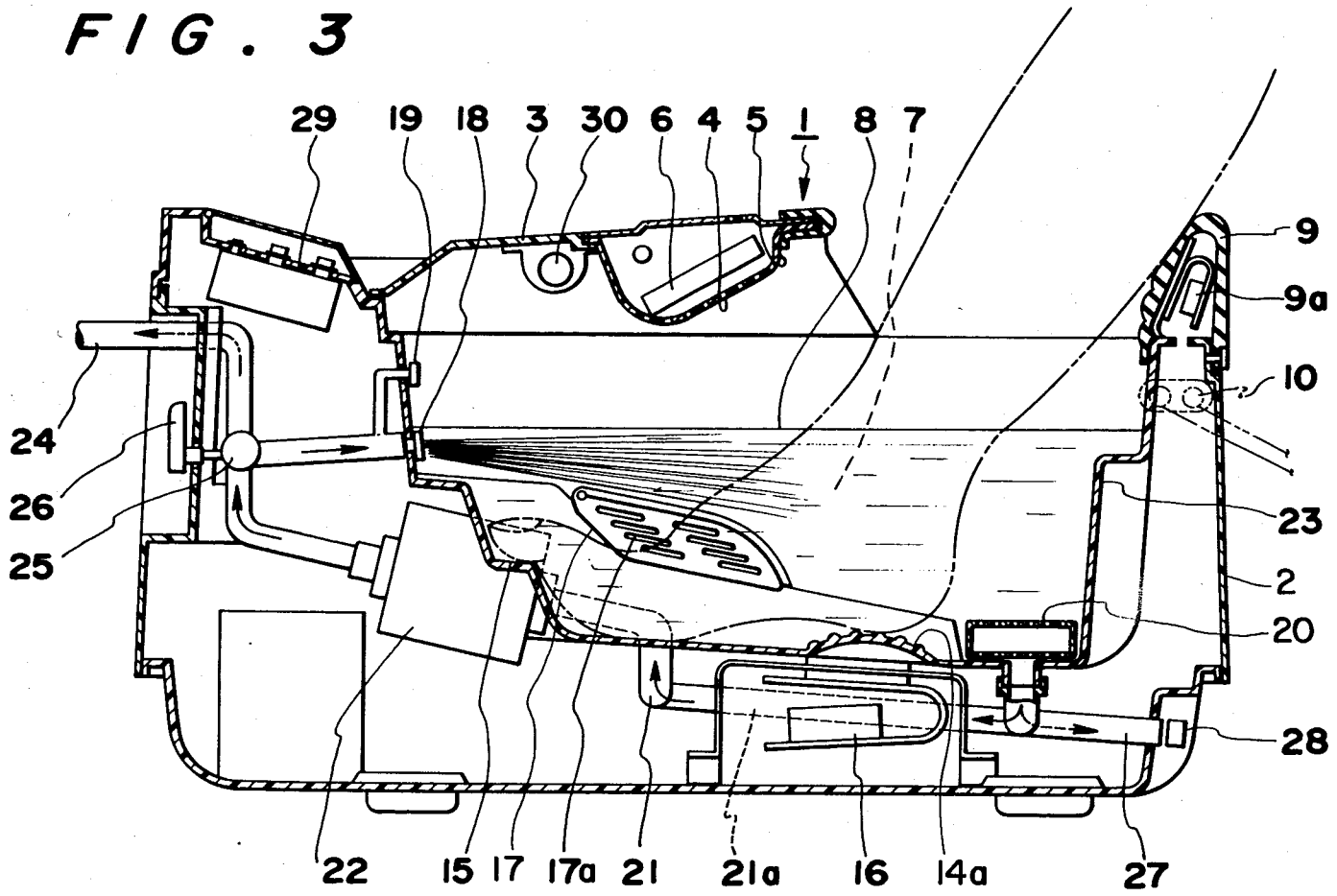
FIG. 3 is a side elevational and sectional view of the foot bath of FIGS. 1 and 2.

As shown in FIG. 3, far infrared radiation ceramic 6 is provided on a back face of the cover 3. A covering plate 5 may be provided on the cover 3 so as to cover the far infrared radiation ceramic 6. Far infrared rays from the far infrared radiation ceramic 6 pass through small holes 4 in the covering plate 5 to be provided to the feet 7 and hot water 8 described later. Heating means (not shown) heats the far infrared radiation ceramic 6 so as to provide a temperature suitable for radiation effects thereto.

As shown in FIG. 1, calf vibration means 9 is provided on the foot bath body 2 at the rear edge thereof. As shown in FIG. 3, the calf vibration means 9 includes a vibrator **9*a* provided therein and a resilient member to engage the user's calves in a suitable manner. The vibrator 9*a* may be preferably of a type producing such a vibration as tunes with music to which the person listens through a headphone. The vibrator 9*a* is supplied with electric power through an electric cord which has a jack 10 inserted into a plug provided on the foot bath body 2. Although the calf vibration means 9 is integrally mounted on the foot bath body 2 at the rear edge thereof, it will be noted that it may be removably mounted on the foot bath body 2. This calf vibration means 9 may be preferably of semicircular cross section so that it engages the calves of the legs of the user 11 who sits on a chair 12, as shown in FIG. 1, and inserts his or her feet 7 into the foot bath 1, as shown in FIG. 3. Thus, it will be noted that a vibration massage is provided to the calves of the user 11. Although not shown, the calf vibration means 9 may be adjustable in its height and/or width, and if otherwise desired, a plurality of calf vibration means 9** of various heights and widths may be prepared and removably mounted on the foot bath body 2.

Figure 2:
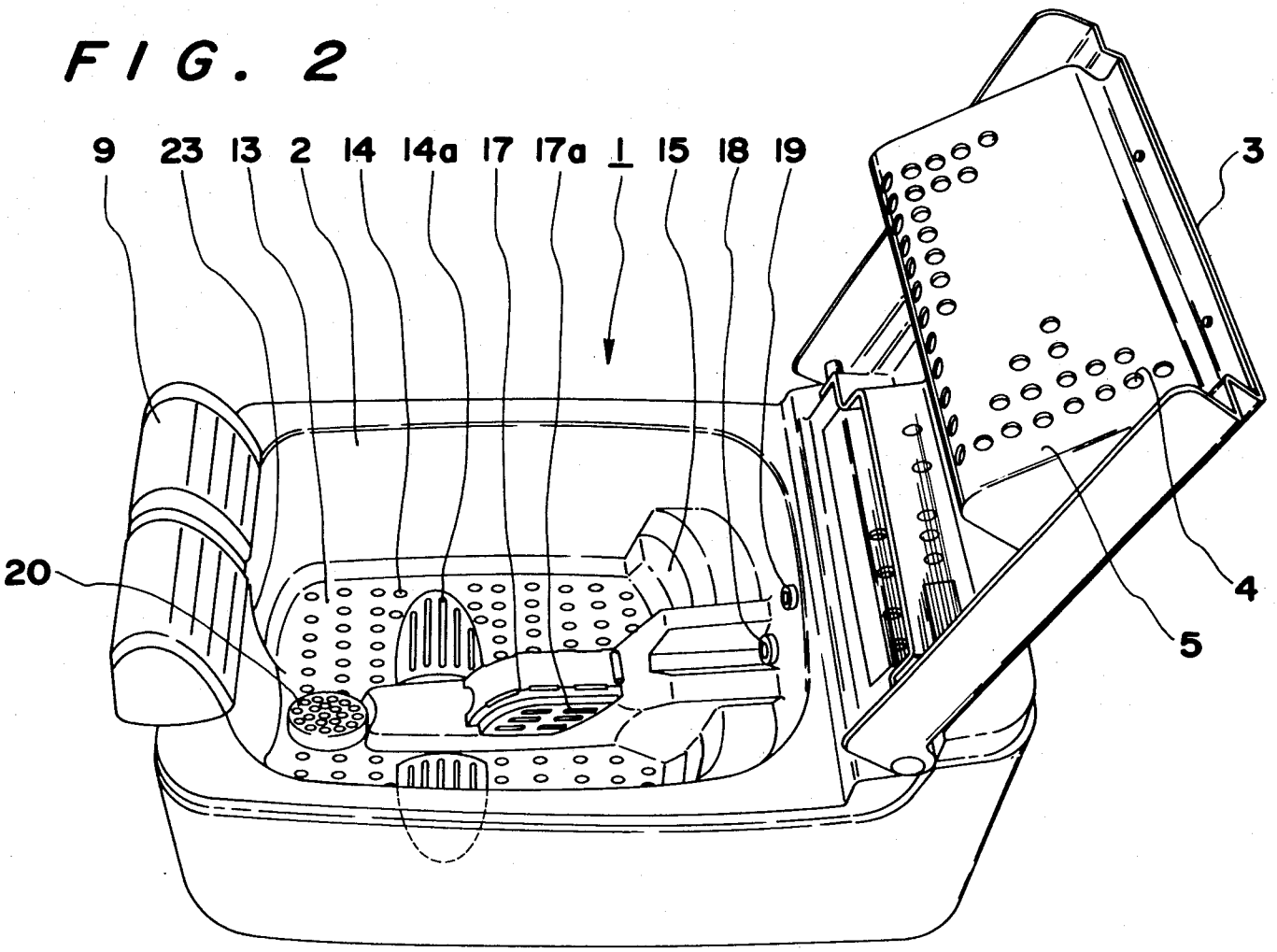
FIG. 2 is a perspective view of the foot bath of FIG. 1 with a cover opened.

As shown in FIG. 2, on the bottom 13 of the foot bath body 2, there are provided a plurality of finger-pressure massaging projections 14 which serve to stimulate the whole sole of the feet and a pair of protrusions 14*a* having a configuration corresponding to the arches of the feet, which protrusions 14*a* serve to stimulate the arches of the feet on which the vital points for lowering blood pressure are concentrated. Toe mounting shoulders 15 are provided in a bent manner for the toes of the feet on which many vital points are concentrated, so that they are stimulated to effectively recover from fatigue and also to stimulate various other organs.

As shown in FIG. 3, a foot vibrator 16 is provided on the underside of the bottom of the foot bath body 2 to massage the feet within the foot bath body 2 by vibration. This vibrator 16 also serves to collectively stimulate the arches of the feet on the protrusions 14*a* and also the toes on the shoulders 15 by its vibration.

A medicine container 17 may be removably provided on the bottom of the foot bath body 2 at the center thereof between the feet inserted into the foot bath body 2. The medicine container 17 contains herbs and solid medicines, which are emitted into the hot water through small holes 17*a* in the medicine container 17.

Hot water jet means is provided and comprises a jet stream injection port 18 which opens at the front face of the foot bath body 2 and an air inlet 19 provided also at the front face of the foot bath body 2 to inhale air. Injection port 18 injects foams into the water jet stream. As shown in FIG. 3, hot water 8 may be introduced through a filter 20 into a hot water pipe 21 on the underside of the bottom of the foot bath body 2 and injected in a foamed manner from the injection port 18 by a pump 22 while combined with the air inhaled through the air inlet 19. The foamed hot water jet stream serves to stimulate the whole feet. The filter 20 serves to remove dirt on the feet and dust such as cottom dust, so that only clean hot water is recirculated to pipe 21. A heating pipe 21*a* is provided at a part of the hot water pipe 21 to heat the water to maintain it at a temperature necessary for stimulating the feet. A drain pipe 24 may be provided to remove the hot water in the foot bath body 2 by means of a change-over valve 25. The change-over valve 25 may be manually operated by a cock 26 or otherwise automatically operated. A drain pipe 27 having a plug 28 may be provided to completely drain the water which cannot be removed through the removal pipe 24.

An operating panel 29 is provided to automatically control the power of the jet water stream and the rhythm vibrator 16. A pilot light 30 may be provided on the back of the cover 3.

It will be noted that the feet within the foot bath body 2 are stimulated by hot water and a jet stream including foams to have a facilitated flow of blood and bteathing of the skin, by stimulus from the arch protrusions 14*a* and the toe mounting shoulders 15, and by radiation of the far infrared rays from the back of the cover 3, as well as by vibration from the vibrator 16 on the bottom of the foot bath body 2 to massage the feet. It will be also noted that the calf vibration means 9 at the rear edge of the foot bath body 2 massages the calves of the legs, which massage most effectively recovers the user from fatigue. Furthermore, it will be noted that hot water can be circulated without its introduction out of the foot bath 1 because there is no requirement of any pump or tank arranged out of the foot bath 1. It will be understood that hot water 8 within the foot bath 1 is maintained by the heating pipe 21*a* at the temperature suitable for the user 11 and for massage of the feet to stimulate them. Since the jet hot water includes foams, it can provide a massage effect to the feet by explosion of foams. Since the foot bath 1 has the filter 20, hot water 8 can be always cleaned. After using the foot bath 1, hot water 8 can be fully removed out of the foot bath 1 by switching the valves 25. Furthermore, since the toes are adapted to be mounted on the shoulders 15, the finger-pressure effect can be provided to the toes by the weight of the toes themselves. It should be noted that stimulus by vibration can be provided not only in a plane but also from hot water and other portions of the foot bath body 2, which causes the feet to be strongly stimulated.

While one preferred embodiment of the invention has been described and illustrated with reference to the accompanying drawings, it will be understood by those skilled in the art that it is by way of example and that various changes and modifications may be made without departing from the spirit and scope of the invention, which is intended to be defined only by the appended claims.

What is claimed is:

1. A foot bath comprising:

a foot bath body having a front wall, a rear wall, an inner bottom, an inner front face, and a cover pivotably mounted on the foot bath body, said cover having an underside and an opening for a person's feet to enter into the foot bath body;

jet means, secured to the inner front face of the foot bath body, for injecting foamed hot water onto the person's feet;

foot vibrating means, arranged on the inner bottom of the foot bath body, for massaging soles of the person's feet and for producing waves of the foamed hot water in the foot bath body;

calf vibrating means, mounted on the rear wall of the foot bath body, for massaging calves of the person;

toe stimulating means, provided at the inner front face of the foot bath body, for engaging the person's toes in a bent manner so that vibration is effectively provided to the person's toes;

finger-like pressuring means, arranged on the inner bottom of the foot bath body, for massaging soles of the person's feet; and infrared radiation means, secured to the underside of the cover, for providing infrared rays to the person's feet.

2. The foot bath, as set forth in claim 1, further comprising:

a medicine container being provided on the inner bottom of the foot bath body about the center thereof and having small holes provided therein for emitting medicine therefrom.

3. The foot bath, as set forth in claim 1, wherein:

said foot vibrating means includes a music maker and produces vibrations in tune with music emanating from the music maker.

4. The foot bath, as set forth in claim 1, wherein:

said jet means includes a pump means for forcibly circulating the hot water to the inner front face of the foot bath body.

5. The foot bath, as set forth in claim 4, further comprising:

means, provided under the inner bottom of the foot bath body, for heating water.

6. The foot bath, as set forth in claim 5, wherein:

said heating means includes a pipe means for delivering the heated up water to the pump means.

7. The foot bath, as set forth in claim 1, further comprising:

filter means, secured to the inner bottom of the foot bath body, for removing dirt and dust from the hot water.

8. The foot bath, as set forth in claim 1, further comprising:

first drain pipe means, secured in the front wall of the foot bath body, for removing the hot water from the foot bath body.

9. The foot bath, as set forth in claim 1, further comprising:

second drain pipe means, secured in the rear wall of the foot bath body, for removing the hot water from the foot bath body.

10. The foot bath, as set forth in claim 1, wherein:

said calf vibrating means includes a resilient means for engaging the calves of the person.

11. The foot bath, as set forth in claim 1, wherein:

said calf vibrating means is fixedly mounted on the rear wall of the foot bath body.

12. The foot bath, as set forth in claim 1, wherein:

said calf vibrating means is removably mounted on the rear wall of the foot bath body.

13. The foot bath, as set forth in claim 1, wherein:

said toe stimulating means includes shoulder means for resting the person's toes thereon.

14. The foot bath, as set forth in claim 1, wherein:

said finger-like pressuring means includes a plurality of projections rising from the inner bottom of the foot bath body.

* * * * *